United States Patent [19]

Borg et al.

[11] Patent Number: 4,660,747

[45] Date of Patent: Apr. 28, 1987

[54] VALVE ELEMENT

[75] Inventors: Bo I. B. Borg, Tumba, Sweden; Peter P. Dudek, Ballerup, Denmark

[73] Assignee: ACO Lakemedel AB, Sweden

[21] Appl. No.: 873,586

[22] Filed: Jun. 12, 1986

Related U.S. Application Data

[63] Continuation of Ser. No. 669,006, Nov. 7, 1984, abandoned.

[51] Int. Cl.[4] ..... B65D 37/00; B65D 25/40

[52] U.S. Cl. ..... 222/213; 222/490; 222/494; 137/844

[58] Field of Search ..... 222/490, 491, 494, 213, 222/212, 206, 566, 567, 570, 569, 544; 215/11 R; 137/844, 845

[56] References Cited

U.S. PATENT DOCUMENTS

| | | | |
|---|---|---|---|
| 1,206,661 | 11/1916 | Booth | 222/490 |
| 2,122,299 | 6/1938 | Sloan | 222/490 |
| 2,188,191 | 1/1940 | Roos | 222/490 |
| 3,445;042 | 5/1969 | Elmore et al. | 222/212 |

FOREIGN PATENT DOCUMENTS

| | | | |
|---|---|---|---|
| 996998 | 12/1951 | France | 222/490 |
| 102087 | 8/1962 | Netherlands . | |

*Primary Examiner*—Joseph J. Rolla
*Assistant Examiner*—David H. Bollinger
*Attorney, Agent, or Firm*—Ostrolenk, Faber, Gerb & Soffen

[57] ABSTRACT

The present invention relates to a valve element for a deformable container for liquid products, such as soap, skin preparations, etc., wherein the valve element is adapted to be located in close proximity to an outlet of the container. The valve element [1] has a yieldable domed section [1*b*] having at least one central slit or fissure [8]. The valve element [1] is arranged to prevent leakage through the slit or fissure [8] when a moderate pressure corresponding to the sum of the atmospheric pressure and the static pressure from the product inside the container is exerted on the domed section [1*a*] of the element but to permit the product to be dispensed from the container when the pressure in the container is increased, the increased pressure acting upon the yieldable domed section [1*a*] to expand the central slit or fissure [8].

14 Claims, 8 Drawing Figures

VALVE ELEMENT

This is a continuation of application Ser. No. 669,006, filed Nov. 7, 1984, now abandoned.

BACKGROUND OF THE INVENTION

This invention relates generally to a valve element for a container. In particular the invention relates to a valve element for use with a container for dispensing liquid products, such as soap, skin-care preparations, etc., said element being located in close proximity to an outlet of the container, which outlet is preferably directed downwardly when in position for dispensing of the liquid product.

For a considerable time there has been a general desire to be able to portion out a liquid product, such as liquid soap, automatically, i.e. without first having to remove a sealing lid or the like. Inumerable solutions have been presented, all of which have been complicated to a lesser or greater degree, and none of which has satisfactorily solved the problems arising, for example, when the product dries around the opening causing clogging.

An object of the present invention is to provide a valve element which is extremely simple in design but which still permits the product to be simply and reliably dispensed, for example, from a deformable container.

SUMMARY OF THE INVENTION

Thus, the invention provides a lid arrangement for a container for liquid products including a valve element. The container has an outlet opening through the liquid product may be dispensed, the valve element being adapted to be located in close proximity to said outlet opening of the container, said valve element comprising a yieldable section and at least one central slit, the yieldable section of the element being domed towards the inside of the container and said slit being arranged in the dome, and wherein the valve element is arranged to prevent leakage through the slit when a moderate pressure, corresponding to the sum of the atmospheric pressure and the static pressure from the product inside the container, is exerted on the domed section of the element but to permit the liquid product to be dispensed from the container when the pressure in the container is increased, the increased pressure acting upon the yieldable section to expand the central slit.

By shaping the element with a yielding section domed towards the inside of the container, in which at least one central slit or fissure is arranged, the element is able efficiently to prevent leakage through the slit or fissure when a moderate pressure corresponding to the sum of the atmospheric pressure and the static pressure from the liquid product inside the container is exerted on the domed section of the element but to permit the liquid product to be dispensed from the container when the pressure in the container is increased, the increased pressure acting upon the yielding section to expand the central slit or fissure through which the product flows as long as an increased pressure in the container is maintained.

Preferably the outer limitation of the domed section is continued to form a sleeve that is open at the lower end and is designed to be arranged around a flange or fitted into a groove or recess surrounding the outlet opening of the container.

Spacers and/or reinforcing ribs may be arranged at the transition between the domed section and the sleeve, in order to give stability to the resilient domed section.

In order to influence the opening and/or closing actions of the slit or fissure, depending on the pressure in the container, upset portions may be arranged adjacent the slit or fissure.

The sealing effect of the valve element under moderate pressure in the container is achieved by the action of the domed section which forcibly presses together the slit or fissure. However, the slit or fissure is preferably arranged to be slightly open when the domed section is unaffected by pressure.

The arrangement of an upset section in the sleeve, said upset section coming into abutment with the flange on which the sleeve is located when in position for use in dispensing liquid, enables a sealing force to be effected on the slit or fissure, so long as the two diametrically located upset sections are arranged on a line with the ends of the slit or fissure in the domed section. If, instead, the valve element is to be inserted into a recess, the upset sections are arranged externally of the sleeve. In this case the location of the upset sections along the length of the sleeve will be displace 90° in relation with their location for a valve element designed to be fitted onto a flange.

The same sealing effect can be achieved if the cross section of the sleeve, when dismantled from the container, is slightly oval, i.e., the valve element is manufactured with an oval sleeve part. This enables the slit or fissure to be manufactured with a narrow opening, which opening being sealed when the valve element is fitted onto the flange or into a recess. The location of the slit in relation to the oval shall in both cases should be such that the slit extends across the domed section from the opposite points where the diameter is smallest.

BRIEF DESCRIPTION OF THE DRAWINGS

In order that the invention may be more readily understood, and so that further features thereof may be appreciated, embodiments of a valve element of the invention will now be described, by way of example, with reference to the accompanying drawings, in which.

DESCRIPTION OF PREFERRED EMBODIMENTS

Figure 1:
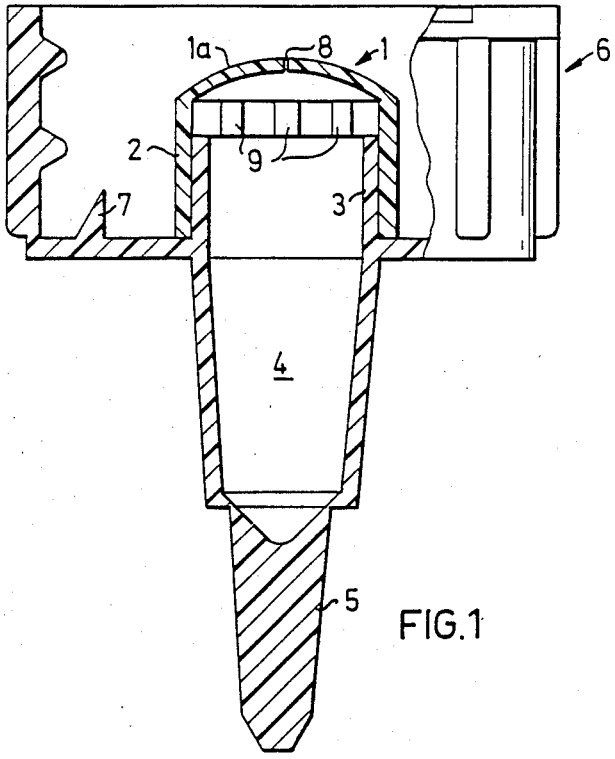
FIG. 1 shows a side view, particularly in section, of a valve element arranged in connection with the outlet nozzle of a container.

FIG. 1 shows a valve element embodying the invention in cooperation with the lid of a container. The valve element 1 has a sleeve 2 that is adapted to be fitted over a flange 3 surrounding an outlet passage 4. The outlet passage 4 is provided with a nozzle 5. The flange 3 forms a part of the screw-on lid 6 of a deformable container (not shown). The lid 6 is also provided with a sealing lip 7 to seal tightly against the opening of the container.

The sleeve 2 is open at one end, and at the other end presents a dome shaped yieldable section 1*a*. The valve element 1 is provided with a central slit or fissure B which is formed in the domed section 1*a* and is kept closed by the exertion of a moderate pressure on the domed section 1*a*. The exertion of increased pressure on the domed section will cause this to be displaced in downward direction, since the domed section 1*a* is elastomerically yielding, whereupon the fissure is enlarged allowing the contents of the container to be dispensed. When the increased pressure in the container is released, the domed section 1*a* of element 1 will return to its original position, thus closing the slit or fissure.

Reinforcing ribs or protrusions 9 are arranged at the transition between sleeve 2 and the domed section 1*a* of the valve element 1. These protrusions are used; both as spacers, to keep the domed section 1*a* correctly spaced from the free edge of the flange 3, and also to restrict the elasticity of the valve element 1 itself.

Figure 2:
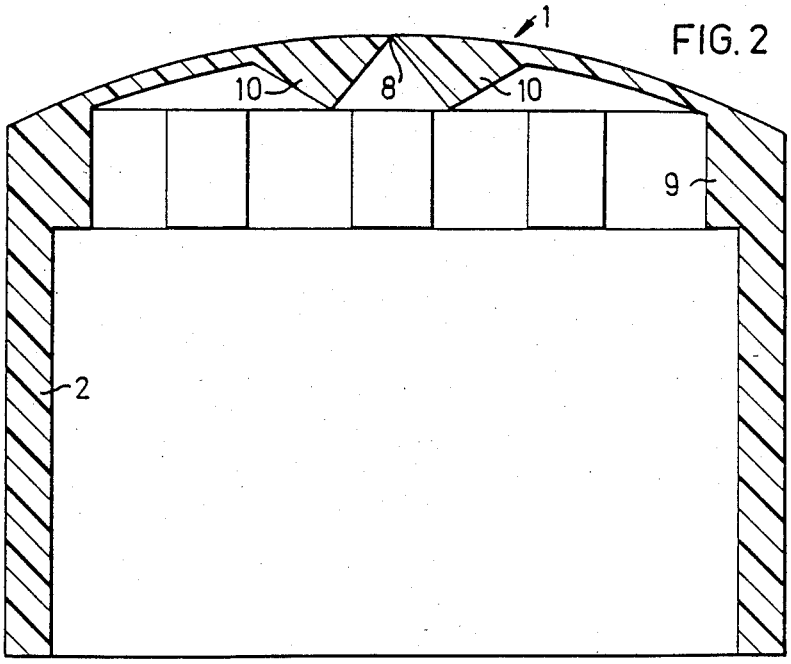
FIG. 2 shows a section through a first alternative embodiment of a valve element according to the invention.

FIG. 2 shows, on a larger scale, a first alternative embodiment of a valve element 1 in which the slit or fissure 8 is surrounded by flange-like sections 10. The flange-like sections act to increase the sealing action of the valve element 1 and give rise to a more defined increase in the container pressure being required before the slit 8 will open to allow the product to be dispensed.

Figure 3:
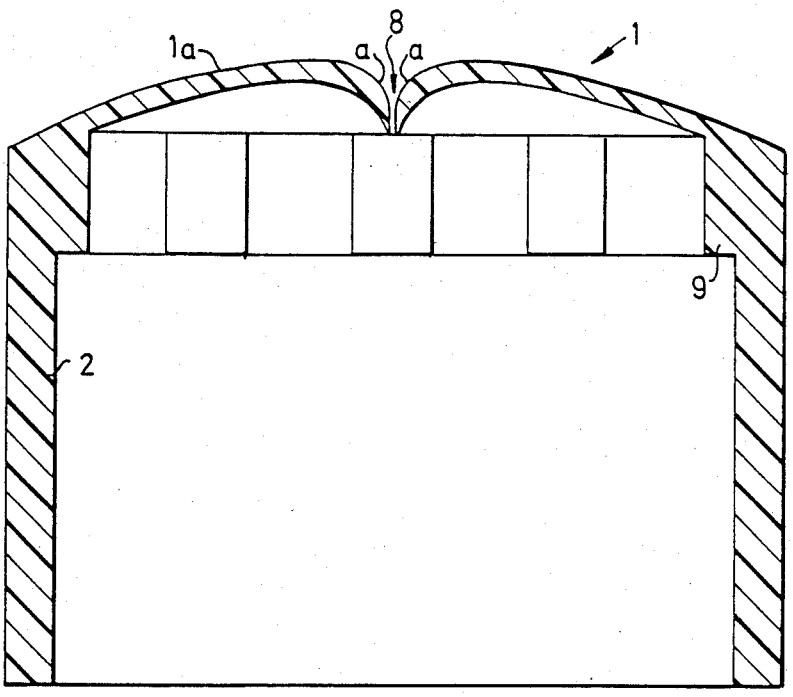
FIG. 3 shows a section through a second alternative embodiment of a valve element according to the invention.

FIG. 3 shows a second alternative embodiment of a valve element 1 in which surfaces a that define the slit or fissure 8 are rounded downwardly. This eliminates the risk of the edges of the slit overlapping each other which could prevent correct functioning of the valve element. The provision of the rounded surface a also reduces the opening pressure required since they will roll against each other when the valve element is opened.

Figure 4:
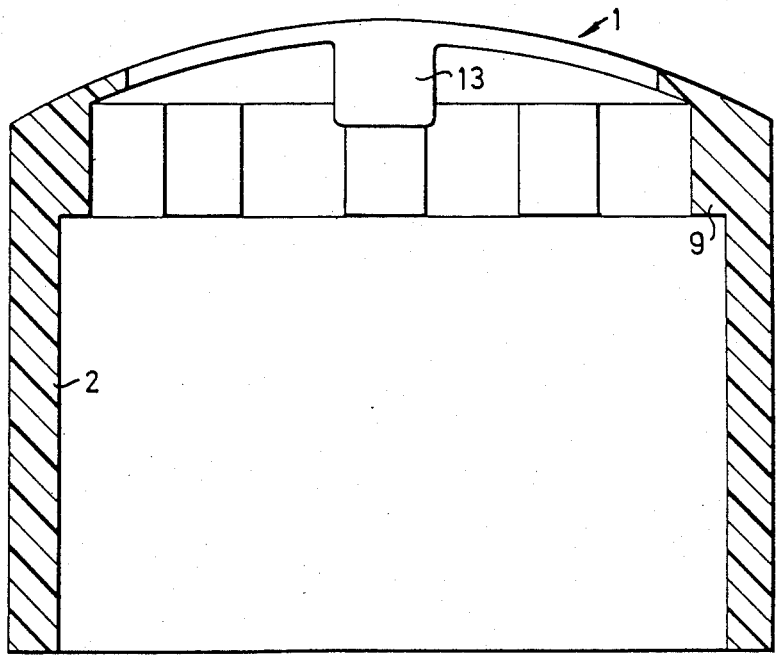
FIG. 4 shows a section through a third alternative embodiment of a valve element according to the invention.

FIG. 4 shows a third alternative embodiment of a valve element 1 in which the slit or fissure 8 is provided with substantially perpendicular, downwardly directed flaps 13 located centrally on the slit and dimensioned to eliminate any risk of overlapping. The downwardly directed flaps 13 also provide an improved sealing action since the contact surface of the edges of the slit as defined by the flaps 13 is increased.

Figure 5:
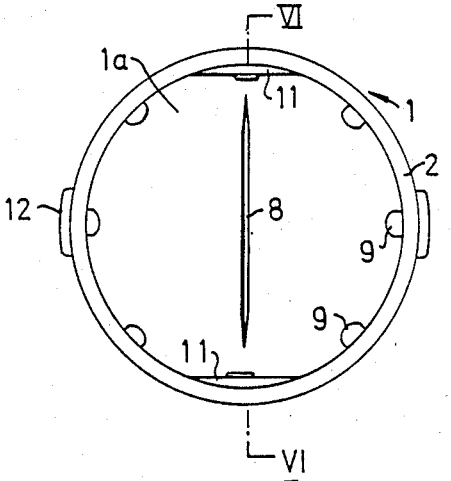
FIG. 5 shows a view from below of another modification of a valve element according to the invention.

FIG. 5 shows a view from below of yet another alternative embodiment of a valve element according to the invention.

Figure 6:
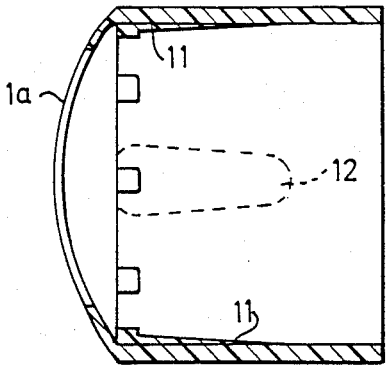
FIG. 6 shows a section through the line VI—VI of FIG. 5.

The major difference between this embodiment and those shown in FIGS. 1 to 4 is the provision of upset sections that are arranged internally, as indicated at 11, or externally, as indicated at 12, on the sleeve 2 of the valve element 1. The provision of either internal or external upset sections depends upon whether the valve element is intended to be received within a flange, as shown in FIG. 5, or about a flange as shown in FIG. 1. As shown in FIG. 6 the upset sections extend along the sheath part of the sleeve 2. In the case of internal upset sections 11, a pressure is exerted on the yielding, domed part 1*a* of the valve element when this is fitted onto the flange 3, thus giving rise to increased sealing action of the slit or fissure 8.

Figure 8:
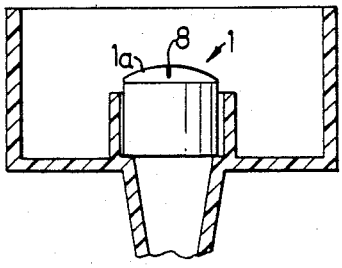
FIG. 8 shows a valve element according to the invention located in a recess arrangement.

If the valve element is to be placed in a cylindrical groove or recess (FIG. 8) the external upset sections 12, which are located diametrically opposite to each other, will exert the same sealing action on the slit or fissure.

Figure 7:
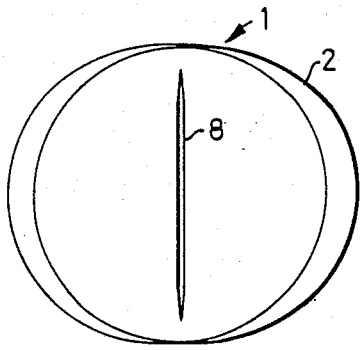
FIG. 7 shows yet another embodiment of a valve element according to the invention, in which the sleeve part is oval (greatly exaggerated in the drawing)

FIG. 7 illustrates yet another method of achieving increased sealing on the slit or fissure, in which the lower part of the sheath of the valve element 1 is formed to be oval in cross-section. This is shown greatly exaggerated in FIG. 7. When a valve element of this shape is placed around a flange or in a groove or recess, the result and deformation will cause increased sealing action on the slit or fissure 8 as described above.

The increased sealing action of the slit or fissure described above allows this to be manufactured with a narrow opening, i.e. the slit or fissure is slightly open in when not assembled.

The invention is in no way limited to the embodiments described above and modifications are feasible within the scope of the following claims.

We claim:

1. A lid arrangement for a container for liquid products, which lid arrangement has an outlet opening through which the liquid product may be dispensed, said opening defined in part by a flange forming an enclosed boundary around said opening, said flange having a first truncated portion oriented inwardly of the container; the lid arrangement including a valve element including a domed resilient yieldable section with the top of the dome oriented inwardly of the container and a sleeve depending from said domed section in a direction outwardly of the container, said sleeve adapted to engage with said flange, said domed resilient yieldable section having at least one central slit, such that the valve element prevents leakage through the slit when a moderate pressure, corresponding to the sum of the atmospheric pressure and the static pressure from the product inside the container, is exerted on the domed section of the element and permits said liquid product to be dispensed from the container when the pressure in the container is increased, the increased pressure acting upon the yieldable section to expand the central slit.

2. A lid arrangement as set forth in claim 1, wherein said sleeve is arranged around said flange.

3. A lid arrangement as set forth in claim 2, wherein upsets are arranged along the length of the sleeve in order to provide an increased closing tension on the slit or fissure.

4. A lid arrangement as set forth in claim 2, wherein the sleeve part of the valve element is oval in cross section.

5. A lid arrangement as set forth in claim 2, wherein ribs are arranged at the transition between the domed section and the sleeve.

6. A lid arrangement as set forth in claim 1, wherein said sleeve is designed to be arranged to fit inside of said flange.

7. A lid arrangement as set forth in claim 6, wherein ribs are arranged at the transition between the domed section and the sleeve.

8. A lid arrangement as set forth in claim 1, wherein upset sections are provided adjacent said slit, wherein the upset sections influence the elastomeric properties of said slit.

9. A lid arrangement as set forth in claim 1, wherein the slit or fissure is provided with substantially perpendicular, downwardly directed edges.

10. A lid arrangement as set forth in claim 1, wherein the slit or fissure is surrounded by flange-like sections.

11. A lid arrangement as set forth in claim 1, wherein the slit or fissure is defined by downwardly rounded surfaces.

12. A lid arrangement as set forth in claim 1, wherein, due to the domed section, the application of increased pressure causes the slit or fissure to be expanded in the direction of feed.

13. A lid arrangement as set forth in claim 1, wherein the slit or fissure is slightly open when no pressure is exerted on the domed section.

14. A lid arrangement as set forth in claim 1, wherein said container outlet is directed downwardly when the container is in a position to dispense said liquid product.

* * * * *